US006325339B1

(12) United States Patent
Lewis

(10) Patent No.: US 6,325,339 B1
(45) **Date of Patent: *Dec. 4, 2001**

(54) ACCESSORY DEVICE FOR COMMUNICATIONS HEADSET

(76) Inventor: William L. Lewis, 2977 E. Overlook, Cleveland Heights, OH (US) 44118

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/102,424

(22) Filed: Jun. 22, 1998

(51) Int. Cl.[7] ..... H01R 13/44
(52) U.S. Cl. ..... 248/74.1; 248/316.7; 439/149
(58) Field of Search ..... 248/74.1, 51, 52, 248/74.3, 316.1, 316.7, 231.81; 24/16 PB, 3.13; 439/148, 149, 150

(56) References Cited

U.S. PATENT DOCUMENTS 4,895,529 * 1/1990 Thakrar et al. ..... 439/281
5,493,073 * 2/1996 Honkomp ..... 439/150

* cited by examiner

*Primary Examiner*—Anita King
*Assistant Examiner*—Jon A Szumny
(74) *Attorney, Agent, or Firm*—Calfee, Halter & Griswold LLP

(57) ABSTRACT

An accessory device for communications headset molded of a microbial resistant material which secures and protects the electrical cords and contacts of a communications headset. The device has a body with a plurality of bores or channels to receive and protect the electrical contacts dependent from the communications headset. The device also has a means to secure the cords when the headset is not in use.

8 Claims, 5 Drawing Sheets

ACCESSORY DEVICE FOR COMMUNICATIONS HEADSET

BACKGROUND OF THE INVENTION

1. Field of the Invention

The present invention relates generally to the field of accessory devices for communications headsets and particularly relates to the securing and protection of electrical contacts and cords dependent from the communications headsets. In general, detachable communications headsets arc widely used in many industries. When not in use, the electrical contacts of the communications headset are usually left unprotected and often become dirty and corroded, therefore, impairing the quality and use of the equipment. Thus, the lifespan of the headset is decreased and there is an increased risk of malfunctioning. Additionally, the cords of the communications headset can fray as a result of improper care and an inability to secure the cords in an efficient and manageable fashion when the headset is not in use. The present invention relates to an accessory device made from polyurethane, or other antimicrobial material, which protects and secures the electrical contacts and cords of the communications headset as well as secures the cords of the headset when not in use, thereby prolonging the lifespan of the equipment and decreasing the risk of malfunction and corrosion.

2. Description of the Prior Art

The utilization of clamps, mounts, and other devices to secure cords and cables is very common. However, in the prior art, none of these devices have been equipped to secure and protect the electrical contacts extending from the cords of the communications headset. Furthermore, most of the clamp devices of the prior art are used by the operator when the communications headset is in use.

For example, the Saiya patent, U.S. Pat. No. 4,346,501 ('501 Patent) discloses a strain relief clamp for supporting a cable dependent from the communications headset. This molded plastic structure attaches to the apparel of the operator wearing the communications headset to secure the cable to the operator's person in order to alleviate the weight pulling downwardly against the operator's head. The strain relief clamp of the '501 Patent is not directed toward the electrical contacts of the headset and does not disclose a device to secure and protect the cords of the communications headset when it is not in use.

Another design, the Chiou Patent, U.S. Pat. No. 4,993,065 ('065 Patent) discloses an accessory communications device for telephone sets to be used by the operator while the telephone set is in use. The '065 Patent provides a necklace-type accessory communications device which fastens the telephone set around the neck of the operator and having a microphone unit and a pair of earphones which allows for hands-free operation of the telephone. Again, this patent does not teach a device used to secure and protect the cords of a communications headset, while the headset is not in use by an operator.

The Law Patent, U.S. Pat. No. 5,243,139 ('139 Patent) discloses a one-piece molded plastic strain relief bushing used to facilitate the laying of wire and to accommodate variable wire sizing. Additionally, the Satoh Patent, U.S. Pat. No. 5,209,441 discloses a clamp for rod like articles which is formed from injection molding of thermoplastic synthetic resin. Although these patents are used to secure and fasten cables, wires, and other rod-like articles, neither teach a device made from a flexible polyurethane used to protect and cleanse the electrical contacts from a communications headset.

SUMMARY OF THE INVENTION

Therefore, it is an object of the invention to provide an accessory device for communications headsets which protects the electrical contacts of the communications headset when the headset is not in use.

It is another object of the present invention to provide an accessory device for communications headsets which secures the cords of the communications headset in an efficient and manageable fashion while the headset is not in use.

Another object of the invention is to cleanse the electrical contacts of the communications headset by taking advantage of the properties of an antimicrobial material such as thermoplastic polyurethane. Thermoplastic polyurethane has outstanding abrasion resistance, impact strength, toughness, and flexibility. It also exhibits excellent microbial resistance.

Still yet another object of the invention is the economic and efficient manufacture of a device to secure and protect electrical contacts and cords of the communications headset.

Other advantages and salient features of the invention will become apparent from the following detailed description of a preferred embodiment when read in conjunction with the accompanying drawings.

BRIEF DESCRIPTION OF THE DRAWINGS

For a better understanding of the invention, reference may be had to the following detailed description in conjunction with the accompanying drawings in which.

It is to be understood that the invention is not limited in its application to the details of construction and arrangement of parts illustrated in the accompanying drawings, since the invention is capable of other embodiments and of being practiced or carried out in various ways.

Also, it is to be understood that the phraseology or terminology employed herein is for the purpose of description and not of limitation.

DETAILED DESCRIPTION OF THE PREFERRED EMBODIMENT

The accessory device for communications headset, embodying the present invention, is composed of a polymer wherein appropriate molding techniques are employed to produce a flexible yet tough device which can withstand repeated use in securing and protecting the electrical cords and contacts of the communications headset.

Figure 1:
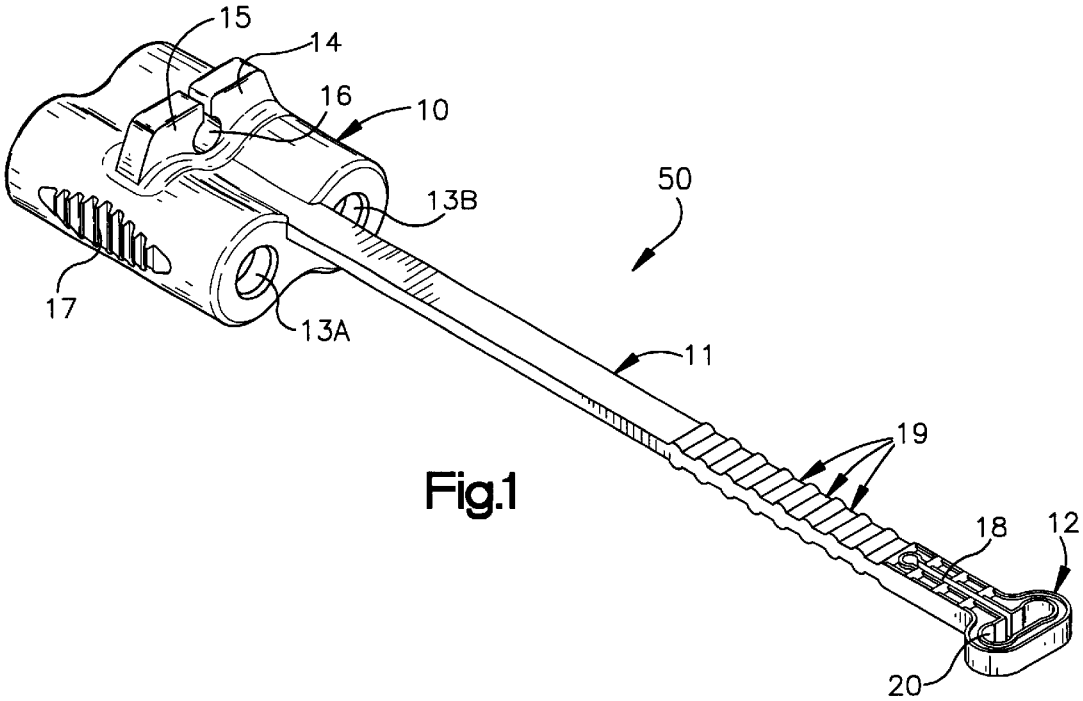
FIG. 1 is a perspective view of the accessory device for communications headset, embodying one of the invention.

Referring to the drawings and particularly to FIG. 1, the preferred embodiment of the accessory device for a communications headset is shown. The accessory device 50 is preferably molded as a complete unitary structure utilizing a strong and relatively flexible material such as polyurethane. The accessory device comprises a body 10, a retainer strap 11 with a handle 12. The body 10 contains a plurality of bores defined by the openings 13A and 13B adapted to receive the plurality of electrical contacts dependent for a communications headset. A plurality of grooves 17 are provided for use as a fingergrip for the operator, in order to facilitate the insertion of the electrical contacts into the bores 13A and 13B of the body 10.

Figure 7:
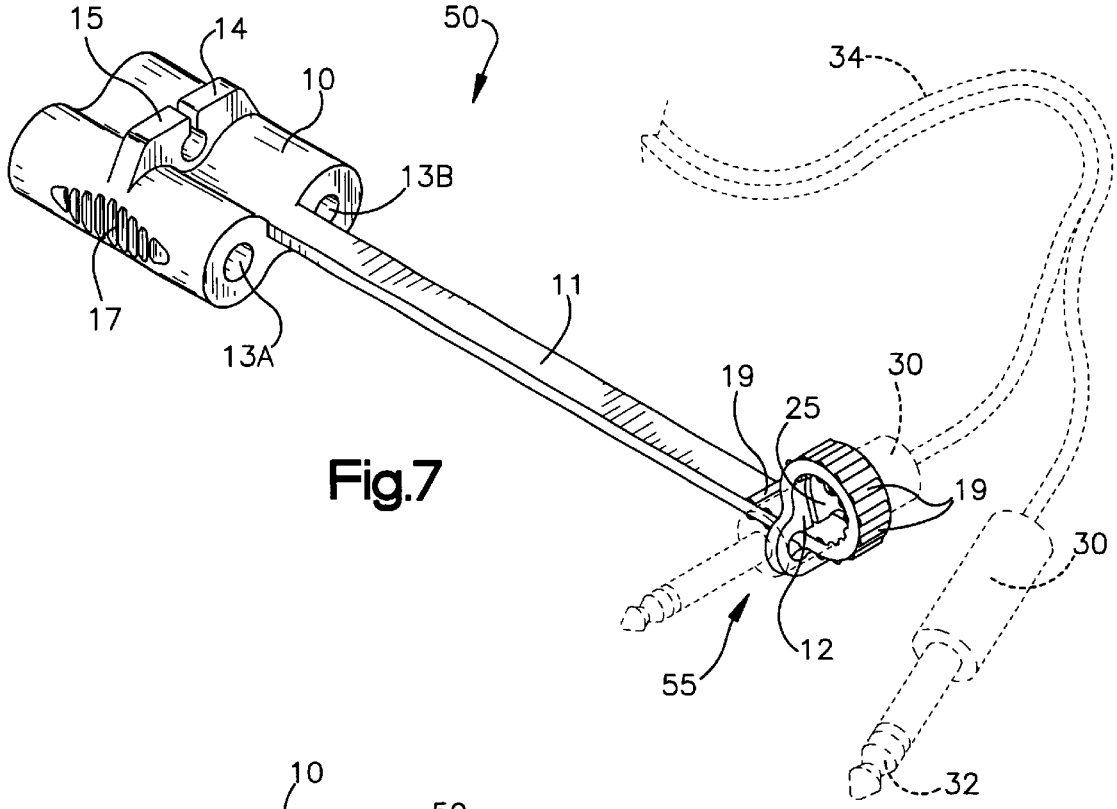
FIG. 7 is a perspective view of the accessory device shown in use with the electrical contacts (in phantom) a headset.

As shown in FIG. 7 when the communications headset 40 is not in use, a looped end 55 may be formed from the strap 11 in order to secure a dependent electrical contact 32 thereon. One way of forming the looped end 55 is by inserting the midsection 19 of the strap 11 into the hole 20 and slit 18 of the handle 12. The midsection 19 is then pulled through the hole 20 until a looped end 55 is formed. Another way of forming the looped end 55 is by inserting the body 10 through the hole 20 and slip 18. The strap 11 thus forms a looped end having an opening 25 through which to insert one of the dependent electrical contacts 32. Once the contact 32 is inserted through the opening 25, the user adjusts the size of the opening 25 such as by, for example, pulling on the distal end of the strap 11, until the opening 25 is of a size sufficient to secure the exterior housing 30 of the contact 32 within the opening 25. In order to ensure the contact housing 30 is secured within the opening 25, the edges of the opening 25 frictionally engage the ridges or chamfers 19 on the retainer strap 11 in order to ensure the opening 25 maintains its size. This feature prevents the opening from enlarging and allowing the exterior housing 30 of the contact 32 from slipping out. In addition, the ridges or chamfers 19 frictionally engage the contact housing 30 so as to ensure the contact housing 30 does not slip out of the opening 25 formed by the strap 11.

Figure 5:
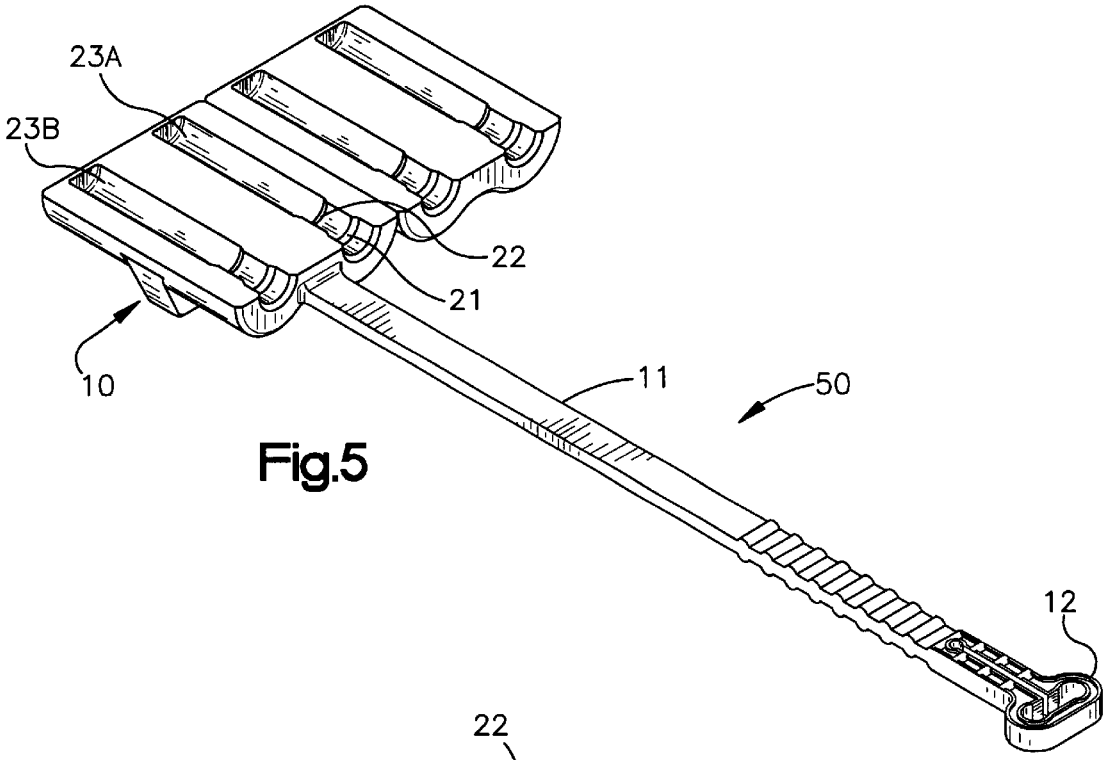
FIG. 5 is an isometric view of the accessory device for communications headset.
Figure 6:
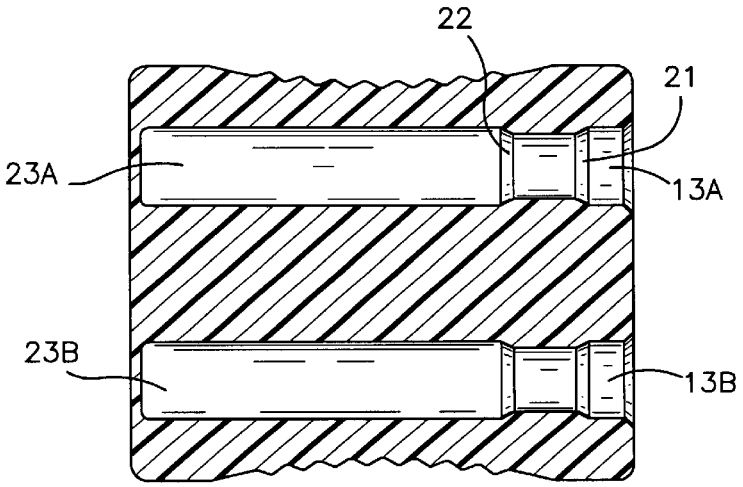
FIG. 6 is a sectional view of the top portion of the body of the accessory device for communications headset.
Figure 8:
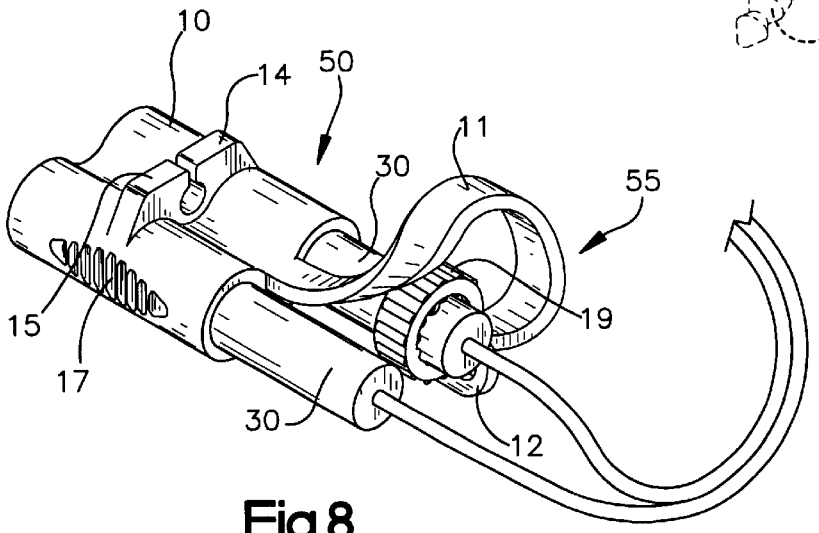
FIG. 8 is a perspective view of the accessory device shown with the electrical contacts installed in the bores of the device of the present invention.
Figure 9:
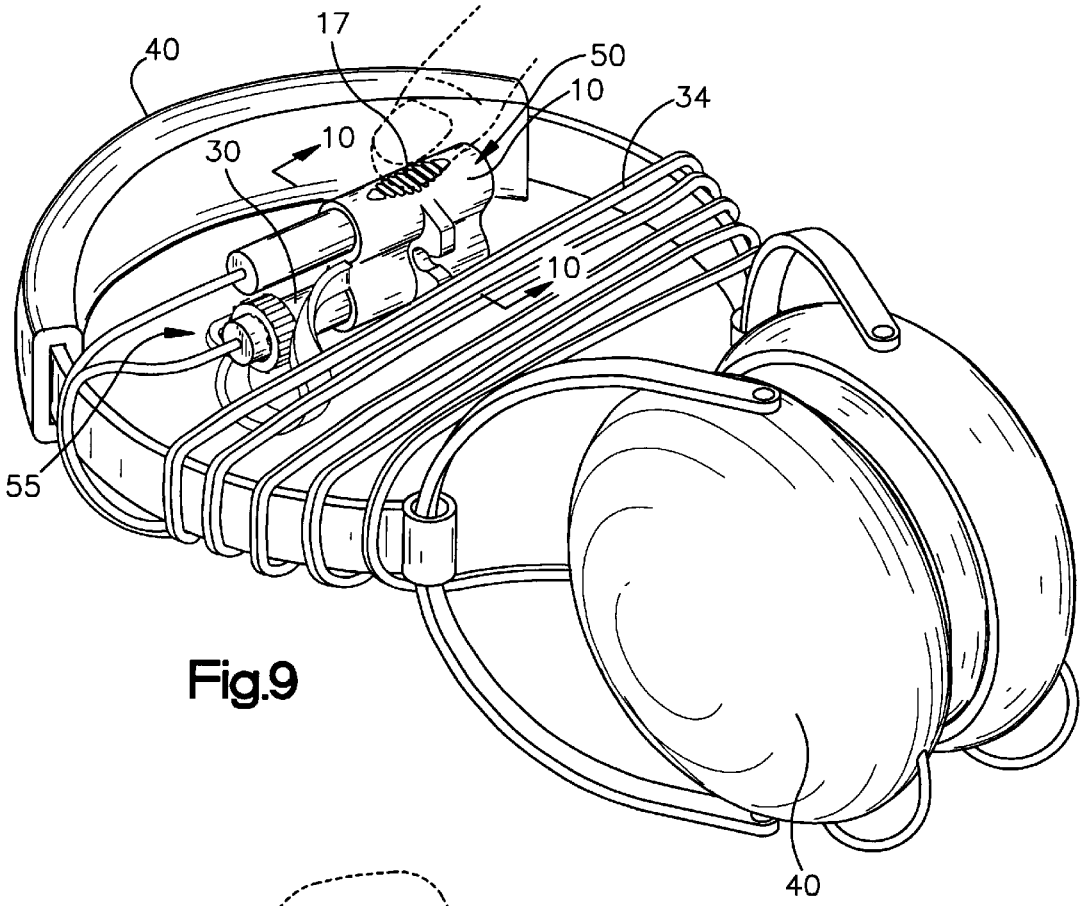
FIG. 9 is a perspective view of the accessory device shown installed in conjunction with a communication headset.

The body 10 of the accessory device 50 contains one or more bores 13A and 13B which define chambers for securing the distal end 32 of an electrical contact 30 therein. Once the accessory device 50 is secured to a contact 30 as described above, the electrical contacts 30 are inserted into the bores 13A and 13B, as shown in FIG. 8. Bores 13A and 13B further comprise one or more ridges 21 and 22 over which the distal end of electrical contact 30 will wipe across or frictionally contact, as best shown in FIGS. 5 and 6. These ridges 21 and 22 wipe and cleanse the electrical contacts to remove any dirt or corrosive material which may accumulate on the contacts through use of the communications headset. Further, in FIG. 2, the accessory device 50 is also shown having smaller bores 23A and 23B at the opposite end of bores 13A and 13B. These bores 23A and 23B are provided so as to prevent moisture build-up within the chambers defined by bores 1 3A and 13B as well as to facilitate the entry of the contacts into the chambers.

Figure 2:
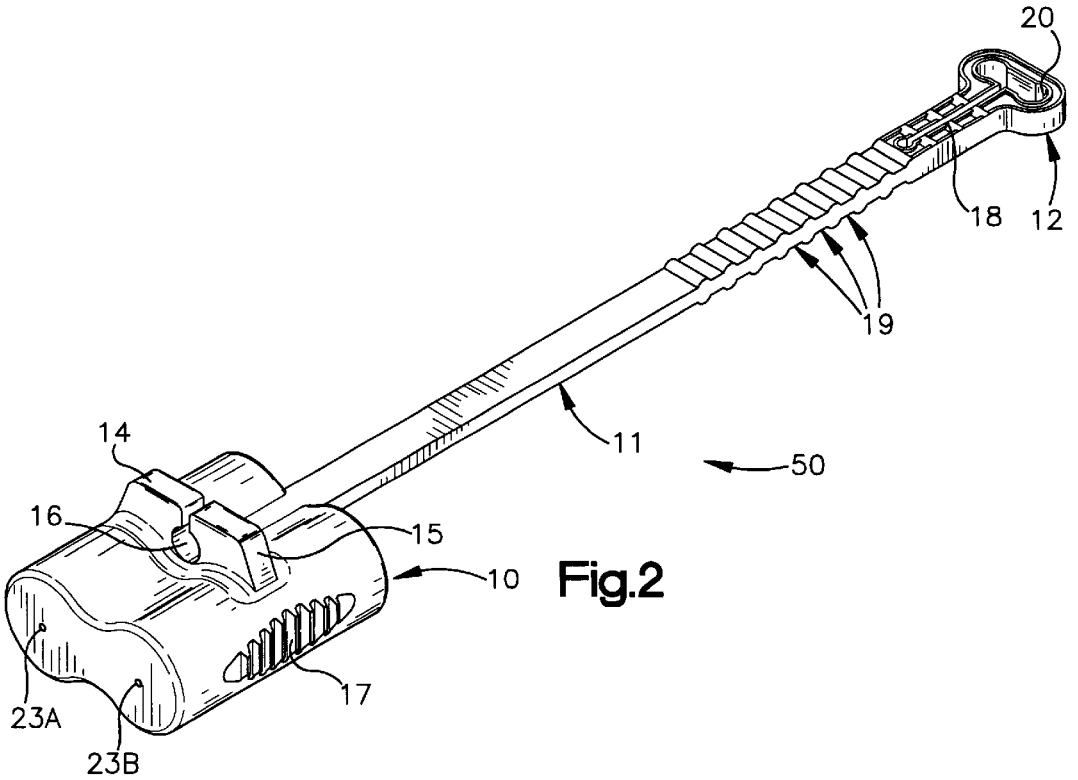
FIG. 2 is an alternate perspective view of the accessory device for communications headset.
Figure 3:
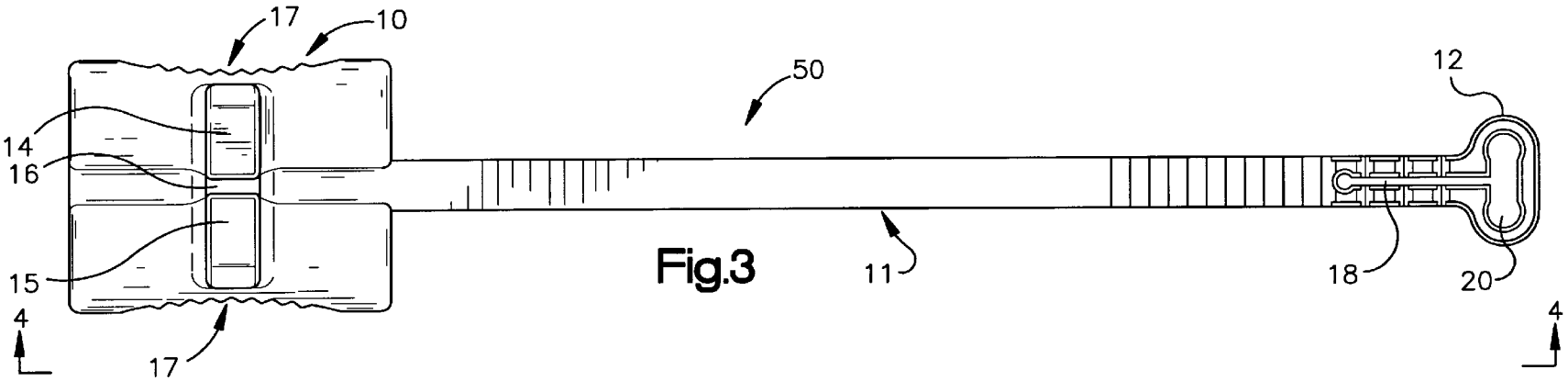
FIG. 3 is a top view of the accessory device for communications headset.
Figure 4:
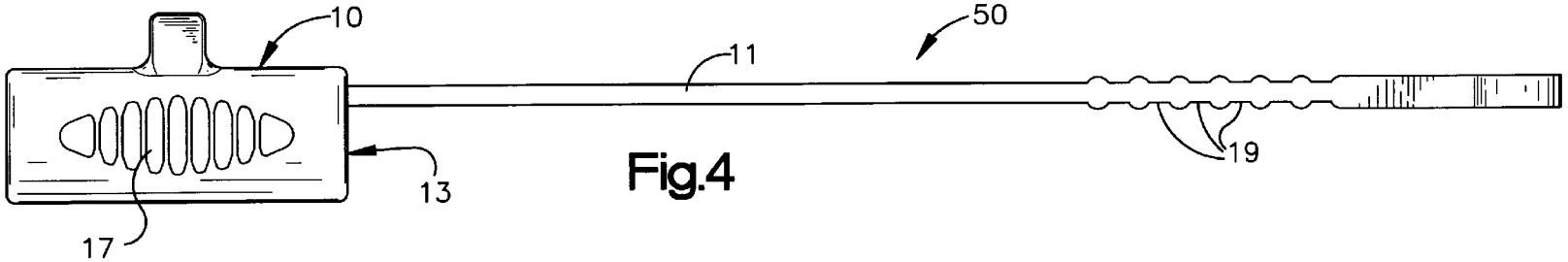
FIG. 4 is a side view of the accessory device for communications headset.
Figure 10:
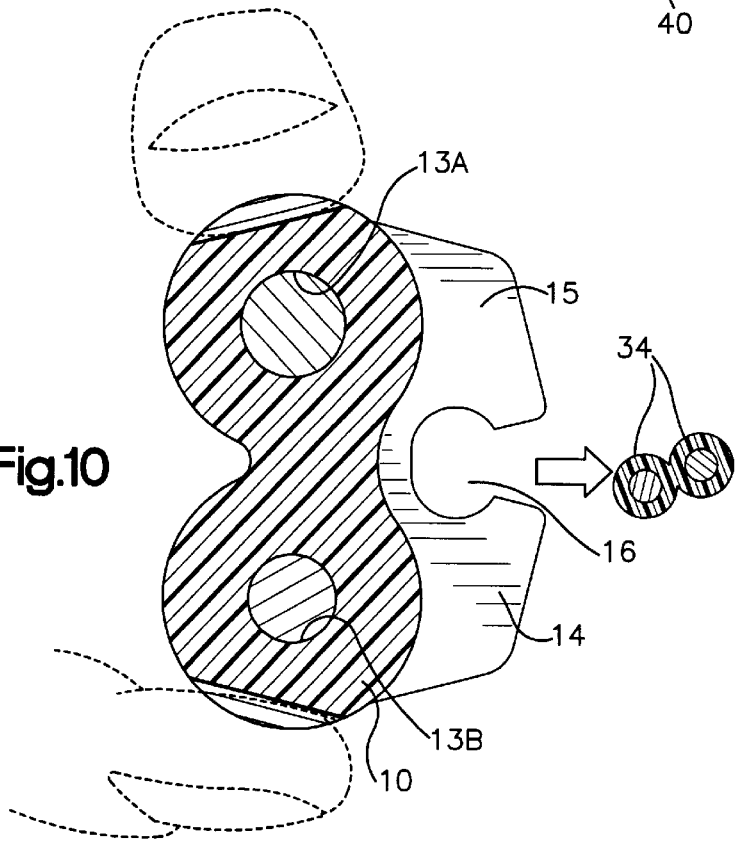
FIG. 10 is a cross-sectional view in the direction 10—10 of FIG. 9 which illustrates the insertion of the cords of the headset installed within the groove of the accessory device of the invention.

As can be seen in FIGS. 1, 2 and 3, the body 10 includes a pair of yieldable clamp arms 14 and 15. Once the electrical cords are wrapped around the headset or secured in some other fashion, the yieldable clamp arms 14 and 15 further secure the cords such that they won't come unraveled. As shown in FIG. 10, when the fingergrip grooves 17 arc squeezed by a user at an angel the channel 16 located between the yieldable clamp arms 14 and 15 is pried open in order to receive the electrical cords 34 of the communications headset 40 for securing and storing the headset cords 34 when the headset 40 is not in use. As the fingergrip grooves 17 are released, the cords of the communications headset remain in the channel 16 to secure the contacts and accessory device 50 to the cords.

It is to be understood that the above detailed description of the embodiments of the invention is provided by way of example only. Various details of design and constructions may be modified without departing from the tile spirit and scope of the invention which is set forth in the appended claims.

What is claimed:

1. An accessory device for securing electrical contacts comprising: a body having one or more bores forming a chamber adapted to receive and secure one or more electrical contacts therein, with each of said bore further comprising one or more internal ridges for contacting an outer surface of said contacts so that said ridges wipe said electrical contacts upon installation and removal from said bore, wherein the body includes opposed yieldable clamp arms mounted upon the body and having opposed end faces forming a channel therebetween wherein the body may be squeezed to widen an opening of the channel whereby an electrical cord may be received and secured therein.

2. The device according to claim 1 wherein said chamber further comprises a hole for allowing ventilation of said chamber.

3. An accessory device for securing one or more electrical contacts dependent from a communication headset, the device comprising: a molded body having one or more bores adapted to receive and secure one or more pin-like electrical contacts therein, with each of said bore further comprising two or more internal ridges for contacting an outer surface of said contacts so that said ridges wipe said electrical contacts upon installation and removal from said bores, wherein said molded body has yieldable clamp arms forming a channel therebetween wherein the arms may be squeezed to widen an opening of the channel for receiving and securing an electrical cord therein, and a flexible strap extending from said molded body and having a handle located on the distal end of said strap with a hole therein wherein a mid-section of said strap may be inserted into the hole of said handle forming a looped end for receiving and securing one of the electrical contacts.

4. An accessory device for securing electrical contacts comprising: a body having one or more bores forming a chamber adapted to receive and secure one or more electrical contacts therein, with each of said bore further comprising one or more internal chamfers for contacting an outer surface of said contacts so that said chamfers wipe said electrical contacts upon installation and removal of said bore, wherein the body includes opposed yieldable clamp arms mounted upon the body and having opposed end faces forming a channel therebetween wherein the body may be squeezed to widen an opening of the channel whereby an electrical cord may be received and secured therein.

5. The device according to claim 4 wherein the body further comprises a flexible strap extending therefrom and having a handle located on the distal end of said strap with a bore therein wherein a mid-section of said strap may be inserted in to the bore of said handle forming a looped end having an opening for receiving and securing an electrical contact therein.

6. The device of claim 4 wherein each of said bores further comprise a hole allowing ventilation of said chamber.

7. The device according to claim 4 wherein the body further comprises a flexible strap extending therefrom and having a handle located on the distal end of said strap with a bore therein wherein a mid-section of said strap may be inserted into the bore of said handle forming a looped end having an opening for receiving and securing an electrical contact therein.

8. The device according to claim 7 wherein the strap further comprises grooves along the length of the strap for engaging surfaces of the handle defining the bore.

* * * * *